US008293689B2

(12) United States Patent
Grisso et al.

(10) Patent No.: US 8,293,689 B2
(45) Date of Patent: Oct. 23, 2012

(54) LUBRICATING COMPOSITION CONTAINING A POLYMER AND ANTIWEAR AGENTS

(75) Inventors: Bryan A. Grisso, Wickliffe, OH (US); Mark R. Baker, Lyndhurst, OH (US); Daniel C. Visger, Mentor, OH (US); Marina Baum, Chagrin Falls, OH (US); Barton J. Schober, Perry, OH (US); Calvin A. James, Madison, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 618 days.

(21) Appl. No.: 12/299,847

(22) PCT Filed: May 7, 2007

(86) PCT No.: PCT/US2007/068335

§ 371 (c)(1), (2), (4) Date: Jun. 29, 2009

(87) PCT Pub. No.: WO2007/133995

PCT Pub. Date: Nov. 22, 2007

(65) Prior Publication Data

US 2009/0312210 A1 Dec. 17, 2009

Related U.S. Application Data

(60) Provisional application No. 60/746,688, filed on May 8, 2006.

(51) Int. Cl.

| | |
|---|---|
| ***C10M 145/14*** | (2006.01) |
| ***C10M 137/08*** | (2006.01) |
| ***C10M 133/06*** | (2006.01) |

(52) U.S. Cl. ..... 508/469; 508/379; 508/443; 508/545; 526/329.7

(58) Field of Classification Search ..... 508/379, 508/471, 469, 443, 545; 526/329.7
See application file for complete search history.

(56) References Cited

U.S. PATENT DOCUMENTS

| | | | | |
|---|---|---|---|---|
| 4,973,733 | A * | 11/1990 | Valkovich et al. | 560/24 |
| 5,652,201 | A * | 7/1997 | Papay et al. | 508/228 |
| 5,703,023 | A | 12/1997 | Srinivasan | |
| 5,763,374 | A | 6/1998 | Sakai et al. | |
| 6,174,843 | B1 * | 1/2001 | Peyton et al. | 508/468 |
| 6,746,993 | B2 | 6/2004 | Yuki et al. | |
| 2003/0036488 | A1 * | 2/2003 | Yuki et al. | 508/469 |
| 2004/0077509 | A1 | 4/2004 | Yuki et al. | |

FOREIGN PATENT DOCUMENTS

| | | | |
|---|---|---|---|
| GB | 922878 | | 4/1963 |
| WO | 03099890 | A2 | 12/2003 |
| WO | 2005103093 | A2 | 11/2005 |
| WO | 2006006519 | A1 | 1/2006 |

OTHER PUBLICATIONS

International Search Report from corresponding PCT Publication No. WO 2007/133995 A3 dated Mar. 20, 2008.
Written Opinion from corresponding international Application No. PCT/2007/068335 dated Jan. 17, 2008.
Derwent Abstract of Japanese Publication No. 2005-557826, Derwent Publications Ltd., London, GB, XP-002464829 (Jan. 20, 2005, Sanyo Chem. Ind. Ltd.).
Derwent Abstract of Japanese Publication No. 2005-126024, Derwent Publications Ltd., London, GB, XP-002464830 (Jan. 20, 2005, Sanyo Chem. Ind. Ltd.).

* cited by examiner

*Primary Examiner* — Jim Goloboy
(74) *Attorney, Agent, or Firm* — Christopher D. Hilker; David M. Shold

(57) ABSTRACT

The invention provides a lubricating composition containing an oil of lubricating viscosity and polymer with pendant groups. The invention further provides for a method of controlling viscosity index by supplying to an oil of lubricating viscosity the polymer with pendant groups.

14 Claims, No Drawings

LUBRICATING COMPOSITION CONTAINING A POLYMER AND ANTIWEAR AGENTS

FIELD OF INVENTION

The present invention relates to a lubricating composition containing (a) an oil of lubricating viscosity, (b) a polymer, and (c) an antiwear agent. The invention further provides for a method and use of controlling viscosity index by supplying to an oil of lubricating viscosity the polymer with pendant groups.

BACKGROUND OF THE INVENTION

Antiwear agents and viscosity index improvers are known to be added to lubricating oil compositions to improve the wear performance and viscosity index of the lubricant respectively.

Common antiwear additives include ash-forming phosphorus compounds and/or ashless forming compounds. Common viscosity index improvers include polymers of methacrylates, acrylates, olefins, or maleic-anhydride styrene copolymers and esterified derivatives thereof. The viscosity index improvers tend to incorporate ester functional groups in pendant/grafted/branched groups. The ester functional groups may be derived from linear alkyl alcohols with 1 to 40 carbon atoms. Recent attempts have been made to produce viscosity index improvers where the ester functional groups have a degree of branching. However, such viscosity index improvers have poor shear stability, viscosity index control and low temperature viscosity.

U.S. Pat. No. 6,746,993 discloses a viscosity index improver defined as a polymer with a solubility parameter of 8.6-9.4, a crystallisation temperature of −15° C., or less and a steric hindrance factor of 0 to 13. The polymer comprises alkyl alkenyl ethers and $C_{1-40}$ alkyl methacrylates, of which some may be β-branched. The viscosity index improver is suitable for gear oils, hydraulic fluids, automatic transmissions and engine oils.

U.S. Pat. No. 5,763,374 discloses lubricating oil compositions containing a copolymer composed of 20-70% of alkyl acrylates, 30-80% alkyl methacrylates. The lubricating oil may be a gear oil or an engine lubricant.

U.S. patent application 2004/0077509 discloses a viscosity index improver polymer suitable for gear oils, transmissions, traction oils, hydraulic oil and engine oils. Further the polymer provides an improved shear stability and low temperature viscosity. The polymer is composed of (meth)acrylates derived from branched alcohols. The branched ester groups contain $C_{18-36}$ alkyl groups, with the proviso that the group does not contain a methylene group containing more than 16 carbon atoms. The polymer further contains 5-90% of either a $C_{8-17}$ alkyl (meth)acrylate or $C_{18-24}$ alkyl (meth)acrylate; and 5-50% of a hydroxy, or amide or carboxyl containing monomer. The monomer with branched ester groups may be present at 5 to 90%, or 10 to 70% or 20 to 60%. Further disclosed are lubricating compositions containing said polymer and a zinc or molybdenum antiwear agent.

Given the performance of the viscosity index improvers of the prior art, it would be desirable to have lubricating compositions capable of providing acceptable/improved wear performance and at least one of acceptable/improved shear stability, viscosity index control and low temperature viscosity. The present invention provides such a lubricating composition.

SUMMARY OF THE INVENTION

The present invention in one embodiment provides a lubricating composition comprising:

(a) an oil of lubricating viscosity;

(b) a polymer of Formula (I), wherein the polymer has pendant groups as represented within $(\ )_w$ of the formula:

Formula (I)

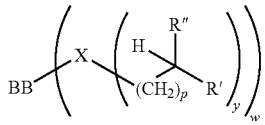

wherein

BB is a polymer backbone;

X is a functional group which either (i) contains at least one carbon and at least one oxygen or nitrogen atom, (ii) contains at least one acylating agent, or (iii) is an alkylene group with about 1 to about 5 carbon atoms (typically —$CH_2$—), connecting the polymer backbone and a branched hydrocarbyl group contained within $(\ )_y$;

w is the number of pendant groups attached to the polymer backbone in the range of about 1 to about 2000, or about 1 to about 500, or about 5 to about 250;

y is 0, 1, 2 or 3, provided that in at least 1 mol % of the pendant groups, y is not zero; and with the proviso that when y is 0, X is bonded to a terminal group in a manner sufficient to satisfy the valence of X, wherein the terminal group is selected from hydrogen, alkyl, aryl, a metal (typically formed during neutralization of ester reactions. Suitable metals include calcium, magnesium, barium, zinc, sodium, potassium or lithium) or ammonium cation, and mixtures thereof;

p is an integer in the range of about 1 to about 15 (or about 1 to about 8, or about 1 to about 4);

R' and R" are independently linear or branched hydrocarbyl groups, and the combined total number of carbon atoms present on R' and R" is at least about 12 (or at least about 16, or at least about 18 or at least about 20); and (c) an antiwear agent, with the proviso that when the antiwear agent is selected from the group consisting of a zinc dialkyldithiophosphate, a molybdenum dithiophosphate and a molybdenum dithiocarbamate, then the polymer is other than a poly(meth)acrylate having about 70% or less of branched hydrocarbyl groups containing linear groups on both R' and R" as represented within $(\ )_y$.

The present invention in one embodiment provides a lubricating composition comprising:

(a) an oil of lubricating viscosity;

(b) a polymer as defined above in Formula (I); and (c) an antiwear agent comprising at least one of:

(i) a non-ionic (thio)phosphorus compound;

(ii) an amine salt of a (thio)phosphorus compound;

(iii) ammonium salt of a (thio)phosphorus compound;

(iv) a monovalent metal salt of a (thio)phosphorus compound; or (v) mixtures of (i), (ii), (iii) or (iv).

The present invention in one embodiment provides a lubricating composition comprising:

(a) an oil of lubricating viscosity;

(b) a polymer as defined above in Formula (I); and (c) an ashless antiwear agent.

In one embodiment the invention provides a lubricating composition comprising:

(a) an oil of lubricating viscosity;

(b) a polymer as defined above in Formula (I), wherein X is a functional group which either (i) contains at least one carbon and at least one oxygen or nitrogen atom, or (ii) contains at least one acylating agent; and (c) an antiwear agent, with the proviso that when the antiwear agent is selected from the group consisting of a zinc dialkyldithiophosphate, a molybdenum dithiophosphate and a molybdenum dithiocarbamate, then the polymer is other than a poly(meth)acrylate having 70% or less of branched hydrocarbyl groups containing linear groups on both R' and R" as represented within $(\ )_y$.

In one embodiment the invention provides a lubricant or lubricant concentrate obtained (or obtainable) by admixing the polymer described herein, the antiwear agent as defined herein and an oil of lubricating viscosity.

In one embodiment the invention provides a method of lubricating a mechanical device, the method comprising supplying to the mechanical device the lubricating composition described herein.

In one embodiment the invention provides a method of controlling the viscosity index of a lubricant, the method comprising supplying a lubricating composition comprising (a) an oil of lubricating viscosity, (b) the polymer defined herein, and (c) the antiwear agent as defined herein.

In one embodiment the invention provides for the use of the lubricating compositions described herein to provide to at least one (or at least two, or all) of acceptable/improved wear performance, acceptable/improved shear stability, acceptable/improved viscosity index control and acceptable/improved low temperature viscosity.

DETAILED DESCRIPTION OF THE INVENTION

The present invention provides a lubricating composition, a method of controlling the viscosity index of a lubricant, and the use of the lubricating composition in a mechanical device.

As used herein the term '(thio)phosphorus' (or other variants including (thio)phosphites) includes phosphorus compounds that are sulphur containing or non-sulphur containing. In one embodiment the phosphorus compound is other than a thiophosphorus compound. In one embodiment the thiophosphorus compounds include dithio or higher thio homologs.

Antiwear Agent

The antiwear agent includes ash-containing (i.e. metal containing) or ashless (i.e. metal free (prior to being mixed with other components)).

In one embodiment the antiwear agent comprises a metal dialkyldithiophosphate. The alkyl groups of the dialkyldithiophosphate include either linear or branched. In one embodiment the antiwear agent is other than a metal dialkyldithiophosphate (often barium or zinc dialkyldithiophosphate).

In one embodiment the amine salt of a (thio)phosphorus compound includes an amine salt of a (thio)phosphorus acid ester, or a monovalent metal salt of a (thio)phosphorus acid ester or mixtures thereof.

The monovalent metal salt typically includes sodium, lithium, potassium or copper.

The amine salt of a (thio)phosphorus acid ester includes (thio)phosphoric acid esters and amine salts thereof; dialkyldithio(thio)phosphoric acid esters and amine salts thereof; amine salts of (thio)phosphites; and amine salts of (thio) phosphorus-containing carboxylic esters, ethers, and amides; and mixtures thereof.

The amine salt of a (thio)phosphorus acid ester may be used alone or in combination. In one embodiment the amine salt of a (thio)phosphorus compound is derived from an amine salt of a phosphorus compound, or mixtures thereof.

In one embodiment the amine salt of a (thio)phosphorus compound includes a partial amine salt-partial metal salt compounds or mixtures thereof. In one embodiment the (thio) phosphorus compound further comprises a sulphur atom in the molecule.

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups contain carbon atoms that are present in ranges including about 2 to about 30, or about 8 to about 26, or about 10 to about 20 or about 13 to about 19.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines include cyclic amines such as piperidine, piperazine and morpholine.

In one embodiment the amine is a tertiary-aliphatic primary amine. The aliphatic group of the tertiary-aliphatic primary amine contains a number of carbon atoms in ranges including about 2 to about 30, or about 6 to about 26, or about 8 to about 24. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the amine salt of a (thio)phosphorus compound includes an amine with C11 to C14 tertiary alkyl primary groups or mixtures thereof. In one embodiment the amine salt of a (thio)phosphorus compound includes an amine with C14 to C18 tertiary alkyl primary amines or mixtures thereof. In one embodiment the amine salt of a (thio)phosphorus compound includes an amine with C18 to C22 tertiary alkyl primary amines or mixtures thereof.

Mixtures of amines may also be used in the invention. In one embodiment a useful mixture of amines is "Primene® 81R" and "Primene® JMT." Primene® 81R and Primene® JMT (both produced and sold by Rohm & Haas) and are mixtures of C11 to C14 tertiary alkyl primary amines and C18 to C22 tertiary alkyl primary amines respectively.

In one embodiment the hydrocarbyl amine salt of an alkyl (thio)phosphoric acid ester is the reaction product of a $C_{14}$ to $C_{18}$ alkylated (thio)phosphoric acid with Primene 81R™ (produced and sold by Rohm & Haas) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™ (Rohm & Haas), and mixtures thereof.

In one embodiment the dithiophosphoric acid is reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is propylene oxide. The glycols include aliphatic glycols having about 1 to about 12, or about 2 to about 6, or about 2 to about 3 carbon atoms. The dithiophosphoric acids, glycols, epoxides, inorganic phosphorus reagents and methods of reacting the same are described in U.S. Pat. Nos. 3,197,405 and 3,544,465. The resulting acids are typically salted with amines. An example of suitable dithiophosphoric acid is prepared by adding phosphorus pentoxide (about 64 grams) at about 58° C. over a period of about 45 minutes to about 514 grams of hydroxypropyl O,O-di(1,3-dimethylbutyl1-2-pentyl)phosphorodithioate (prepared by reacting di(1,3-dimethylbutyl)-phosphorodithioic acid with about 1.3 moles of propylene oxide at about 25° C.). The mixture is heated at about 75° C. for about 2.5 hours, mixed with a diatomaceous earth and filtered at about 70° C. The filtrate contains about 11.8% by weight phosphorus, about 15.2% by weight sulphur, and an acid number of 87 (bromophenol blue).

In one embodiment the antiwear agent comprises a non-ionic (thio)phosphorus compound. Typically the non-ionic (thio)phosphorus compound has an oxidation of +3 or +5. The other embodiments the non-ionic (thio)phosphorus compound comprises (thio)phosphite ester, (thio)phosphate esters, or mixtures thereof. A more detailed description of the non-ionic (thio)phosphorus compound include column 9, line 48 to column 11, line 8 of U.S. Pat. No. 6,103,673.

The antiwear agent is present in the lubricating composition in ranges including about 0.01 wt % to about 20 wt %, or about 0.05 wt % to about 10 wt %, or about 0.1 wt % to about 5 wt % of the lubricating composition.

Polymer

Methods of preparing the polymer are described in more detail in co-pending application filed on the same day with named inventors of Visger, Baum, Grisso, Baker and James).

In general terms the polymer is prepared by a batch, semi-batch or continuous process. The process comprises mixing in an inert atmosphere (e.g., nitrogen or argon) a monomer composition (to provide a suitable polymer composition), with an initiator (e.g., Trigonox®21, commercially available from Ciba Specialty Chemicals as t-butyl peroactate), optionally in the presence of chain transfer agents (such as n-dodecyl mercaptan), solvents (such as oil or aromatic hydrocarbons (e.g., toluene or benzene)), and optionally quenching agents. Polymerisation process used to prepare the polymer include anioinic or radical polymerisation. Radical polymerisation processes are performed at a temperature a range including about 20° C. to about 150° C., or about 40° C. to about 125° C. Anioinic polymerisation process are performed at a range including about −80° C. to about 50° C., or about −70° C. to about 0° C. During polymerisation if a particular polymer architecture is desired e.g., block copolymers the monomers are added to the polymerisation system in known ways to provide the desired architecture.

In one embodiment the polymer has a steric hindrance factor F that is defined by the equation:

$$F=4U+Y$$

wherein F is the steric hindrance factor; U and Y represent the total atom numbers at the 6th position and the 7th position, respectively, in the side chain(s), counted from the backbone. A more detailed discussion on how to calculate the steric hindrance factor is given in U.S. Pat. No. 6,746,993, column 10, line 3 to column 11, line 3.

In other embodiments the polymer has a steric hindrance factor of one or more, or 1 to about 30.

As used herein the term "poly(meth)acrylate" includes both a polymethacrylate and a polyacrylate.

For a polymer other than a poly(meth)acrylate, the steric hindrance factor includes ranges of 0 to about 30 or about 2 to about 20.

For a poly(meth)acrylate polymer, the steric hindrance factor includes ranges of greater than about 13 to about 30, or about 20 to about 30, or about 25 to about 30.

In other embodiments a polymer (other than a poly(meth) acrylate) with pendant groups typically contains about 20% to about 100%, or about 50% to about 100%, or about 70% to about 100%, of about 85% to about 100% branched hydrocarbyl groups represented by a group within $(\ )_y$ of the formula above.

All of the polymer of the invention in other embodiments typically contains greater than 90% to 100 or less, or about 92% to about 100% or less, or about 95% to about 100% or less, branched hydrocarbyl groups represented by a group within $(\ )_y$ of the formula above.

The poly(meth)acrylate in other embodiments contains about 92% to about 100% or less, or about 95% to about 100% or less, branched hydrocarbyl groups represented by a group within $(\ )_y$ of the formula above.

In other embodiments the functional groups defined by X on the formula above, comprises at least one of —$CO_2$—, —C(O)N═, or —$(CH_2)_v$—, wherein v is an integer in a range of about 1 to about 20, or about 1 to about 10, or 1 to 2.

In one embodiment X is derived from a carboxylic monomer Examples of a suitable carboxylic monomer include maleic anhydride, maleic acid, (meth)acrylic acid, itaconic anhydride or itaconic acid. In one embodiment the carboxylic monomer includes maleic anhydride or maleic acid.

In one embodiment X is other than an alkylene group, connecting the polymer backbone and the branched hydrocarbyl groups.

In other embodiments the pendant groups include esterified, amidated or imidated functional groups. In one embodiment the pendant groups is derived from esterified and/or amidated functional groups. In one embodiment the polymer comprises esterified pendant groups.

Examples of suitable groups for R' and R" on the formula defined above include the following:

1) alkyl groups containing $C_{15-16}$ polymethylene groups, such as 1-$C_{1-15}$ alkyl-hexadecyl groups (e.g. 1-octylhexadecyl) and 2-alkyl-octadecyl groups (e.g. 2-ethyloctadecyl, 2-tetradecyl-octadecyl and 2-hexadecyloctadecyl);

2) alkyl groups containing $C_{13-14}$polymethylene group, such as 1-$C_{1-15}$ alkyl-tetradecyl groups (e.g. 1-hexyltetradecyl, 1-decyltetradecyl and 1-undecyltridecyl) and 2-$C_{1-15}$alkyl-hexadecyl groups (e.g. 2-ethyl-hexadecyl and 2-dodecylhexadecyl);

3) alkyl groups containing $C_{10-12}$polymethylene group, such as 1-$C_{1-15}$ alkyl-dodecyl groups (e.g. 1-octyldodecyl) and 2-$C_{1-15}$alkyl-dodecyl groups (2-hexyldodecyl and 2-octyldodecyl), 2-$C_{1-15}$alkyl-tetradecyl groups (e.g. 2-hexyltetradecyl and 2-decyltetradecyl);

4) alkyl groups containing $C_{6-9}$polymethylene group, such as 2-$C_{1-15}$ alkyl-decyl groups (e.g. 2-octyldecyl and 2,4-di-$C_{1-15}$ alkyl-decyl groups (e.g. 2-ethyl-4-butyl-decyl group);

5) alkyl groups containing $C_{1-5}$polymethylene group, such as 2-(3-methylhexyl)-7-methyl-decyl and 2-(1,4,4-trimethylbutyl)-5,7,7-trimethyl-octyl groups; and 6) and mixtures of two or more branched alkyl groups, such as alkyl residues of oxoalcohols corresponding to propylene oligomers (from hexamer to undecamer), ethylene/propylene (molar ratio of about 16:1-1:11) oligomers, iso-butene oligomers (from pentamer to octamer), $C_{5-17}$ α-olefin oligomers (from dimer to hexamer).

The pendant groups typically contains a total combined number of carbon atoms on R' and R" in the range of about 12 to about 60, or about 14 to about 50, or about 16 to about 40, or about 18 to about 40, or about 20 to about 36.

Each of R' and R" typically contains about 5 to about 25, or about 8 to about 32, or about 10 to about 18 methylene carbon atoms. In one embodiment the number of carbon atoms on each R' and R" group comprises about 10 to about 24.

Examples of suitable monomers capable of forming the pendant group include branched alkyl methacrylates such as 2-octyldodecyl and 2-decyltetradecyl methacrylates, and 2-tetradecyloctadecyl, 2-hexyl-dodecyl, 2-hexyltetradecyl, 2-ethylhexadecyl, 2-dodecylhexadecyl, 2-octyldodecyloxyethyl and 2-decyltetradecyl-oxyethyl methacrylates. In one embodiment the pendant group includes branched alkyl acrylates that are the same as those listed above for the corresponding methacrylates, such as 2-octyldodecyl acrylate or 2-decyltetradecyl acrylate.

The polymer in one embodiment is amidated with amines including 2-decyl-tetradecylamine, 2-tetradecyl-octadecylamine, 2-methyl-ethylamine, or mixtures thereof.

The polymer has a weight average molecular weight in ranges including about 1000 to about 2,000,000, or about 4000 to about 1,000,000, or about 6000 to about 100,000, or about 7,000 to about 80,000. Typically the polydispersity of the polymer is in the range of about 1 to about 5, or about 1.5 to about 4.

As described hereinafter the molecular weight of the viscosity modifier has been determined using known methods, such as GPC analysis using polystyrene standards.

The polymer may be a homopolymer or a copolymer. The polymer architecture includes a linear, comb, cross-linked or star structures.

In other embodiments the polymer comprises a polymethacrylate composed of about 75 wt % or more, or about 85 wt % or more, or greater than 90 wt % or more, or about 92 wt % of methacrylate repeat units.

In different embodiments, when the polymer comprises a polymethacrylate, 0 wt % to less than about 20 wt %, or 0 wt % to about 10 wt %, or 0 wt % to about 5 wt %, or 0 wt % of repeat units are derived from an alkyl acrylate.

In different embodiments, when the polymer comprises a poly(meth)acrylate, 0 wt % to less than about 20 wt %, or 0 wt % to about 10 wt %, or 0 wt % to about 5 wt %, or 0 wt % of repeat units are derived from methyl methacrylate.

Polymer Backbone

The polymer with pendant groups has a polymer backbone (BB in the formula above) where the variable BB typically only encompasses a carbon chain. Other functional groups that are commonly attached to the polymer backbone such as carboxylic groups, amines, amides, imides, and the like are considered part of pendant groups.

In one embodiment the polymer with pendant groups comprises at least one polymer backbone (BB in the formula above) composed of at least one of (a) a polymer derived from monomers comprising: (i) a vinyl aromatic monomer; and (ii) a carboxylic monomer (typically maleic anhydride, maleic acid, (meth)acrylic acid, itaconic anhydride or itaconic acid) or derivatives thereof; (b) a poly(meth)acrylate; (c) a functionalised polyolefin; (d) an ethylene vinyl acetate copolymer; (e) a fumarate copolymer; (f) a copolymer derived from (i) an α-olefin and (ii) a carboxylic monomer (typically maleic anhydride, maleic acid, (meth)acrylic acid, itaconic anhydride or itaconic acid) or derivatives thereof; or (g) mixtures thereof. In one embodiment the polymer with pendant groups comprises a polymethacrylate.

The carboxylic monomer includes an acid or anhydride or derivatives thereof that is wholly esterified, partially esterified or mixtures thereof. When partially esterified other functional groups include acids, salts or mixtures thereof. Suitable salts include alkali metals, alkaline earth metals or mixtures thereof. The salts include lithium, sodium, potassium, magnesium, calcium or mixtures thereof. The unsaturated carboxylic acid or derivatives thereof includes an acrylic acid, a methyl acrylate, a methacrylic acid, a maleic acid or anhydride, a fumaric acid, an itaconic acid or anhydride or mixtures thereof.

Suitable examples of the carboxylic monomer include itaconic anhydride, maleic anhydride, methyl maleic anhydride, ethyl maleic anhydride, dimethyl maleic anhydride or mixtures thereof.

In one embodiment the carboxylic monomer comprises maleic anhydride or derivatives thereof.

In one embodiment the functionalised polyolefin is grafted with a carboxylic monomer (typically the carboxylic monomer is maleic anhydride, maleic acid, (meth)acrylic acid, itaconic anhydride or itaconic acid). The polyolefin includes those derived from an ethylene monomer and at least one other comonomer derived from an alpha-olefin having the formula $H_2C{=}CHR^1$, wherein $R^1$ is a hydrocarbyl group (for example an alkyl radical containing 1 to about 18, or 1 to about 10, or 1 to about 6, or 1 to about 3 carbon atoms). The hydrocarbyl group includes an alkyl radical that has a straight chain, a branched chain or mixtures thereof. Examples of a comonomer include propylene, 1-butene, 1-hexene, 1-octene, 4-methyl-1-pentene, 1-decene or mixtures thereof. In one embodiment the comonomer includes 1-butene, propylene or mixtures thereof. Examples of the olefin copolymers include ethylene-propylene copolymers, ethylene-1-butene copolymers or mixtures thereof.

In another embodiment the alpha-olefin includes a comonomer, wherein the comonomer contains a number of carbon atoms in ranges of about 6 to about 40, or about 10 to about 34, or about 14 to about 22. Examples of an alpha-olefin include 1-decene 1-undecene, 1-dodecene, 1-tridecene, 1-tetradecene, 1-pentadecene, 1-hexadecene, 1-heptadecene 1-octadecene, 1-nonadecene, 1-eicosene, 1-doeicosene, 2-tetracosene, 3-methyl-1-henicosene, 4-ethyl-2-tetracosene or mixtures thereof. Useful examples of an alpha-olefin include 1-pentadecene, 1-hexadecene, 1-heptadecene 1-octadecene, 1-nonadecene or mixtures thereof. The alpha-olefin is often commercially available as mixtures especially as $C_{16}$-$C_{18}$.

In one embodiment the polymer includes a copolymer of an α-olefin and di-acid or an anhydride thereof (typically maleic anhydride, maleic acid, itaconic anhydride or itaconic acid. A more detailed description of suitable copolymer of an α-olefin and an unsaturated di-acid or an anhydride thereof is given in U.S. Pat. No. 6,419,714 and U.S. Pat. No. 4,526,950.

In one embodiment the polymer is derived from monomers comprising: (i) a vinyl aromatic monomer; and (ii) a carboxylic monomer (such as, an unsaturated carboxylic acid or derivatives thereof), prior to esterification may also be referred to as an interpolymer.

Examples of a vinyl aromatic monomer include styrene (also referred to as ethenylbenzene), substituted styrene or mixtures thereof. Examples of a suitable substituted styrene include alpha-methylstyrene, para-methylstyrene (also referred to as vinyl toluene), para-tert-butylstyrene, alpha-ethylstyrene or mixtures thereof.

The molecular weight of the interpolymer may also be expressed in terms of the "reduced specific viscosity" of the polymer which is recognized means of expressing the molecular size of a polymeric substance. As used herein, the reduced specific viscosity (abbreviated as RSV) is the value obtained in accordance with the formula RSV=(Relative Viscosity−1)/Concentration, wherein the relative viscosity is determined by measuring, by means of a dilution viscometer, the viscosity of a solution of about 1 g of the polymer in about 10 $cm^3$ of acetone and the viscosity of acetone at about 30° C. For purpose of computation by the above formula, the concentration is adjusted to about 0.4 g of the interpolymer per about 10 $cm^3$ of acetone. A more detailed discussion of the reduced specific viscosity, also known as the specific viscosity, as well as its relationship to the average molecular weight of an interpolymer, appears in Paul J. Flory, Principles of Polymer Chemistry, (1953 Edition) pages 308 et seq. The interpolymer polymer of the invention has a RSV of about 0.05 to about 2, or about 0.06 to about 1, or about 0.06 to about 0.8. In one embodiment the RSV is about 0.69. In other embodiments the RSV is about 0.07, or about 0.05, or about 0.12. In one embodiment the Mw of the interpolymer is about 10,000 to about 300,000.

In one embodiment the polymer is an esterified styrene-maleic anhydride copolymer, wherein anhydride units of the copolymer are subsequently esterified with a branched alcohol that forms the branched hydrocarbyl groups as represented within $(\ )_y$ of the formula above.

In one embodiment the polymer further comprises a nitrogen containing group. The nitrogen containing group includes those derived from a nitrogen containing compound capable of reacting with a functionalised polymer backbone. In one embodiment the nitrogen containing compound is further attached to the polymer through an amide functionality. The polymer with a nitrogen containing group may also be referred to as a dispersant viscosity modifier (or DVM).

In one embodiment the nitrogen containing compound comprises a nitrogen containing monomer. In one embodiment the nitrogen containing monomer is attached onto the polymer chain either by free radical grafting or copolymerisation. The nitrogen containing monomer typically comprises a (meth)acrylamide or a nitrogen containing (meth) acrylate monomer. The nitrogen containing compound comprising a (meth)acrylamide or nitrogen containing (meth) acrylate monomer is suitable for functionalizing (i) a poly (meth)acrylate and/or (ii) a polymer derived from monomers comprising: (i) a vinyl aromatic monomer; and (ii) an unsaturated carboxylic acid or derivatives thereof. The polymer (ii), includes those prepared by condensing a portion or all of the unsaturated carboxylic acid or derivatives thereof with the nitrogen containing compound. The (meth)acrylamide or the nitrogen containing (meth)acrylate monomer includes those represented by the formula:

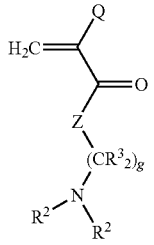

wherein

Q is hydrogen or methyl and, in one embodiment, Q is methyl;

Z is a N—H group or O (oxygen);

each $R^2$ is independently hydrogen or hydrocarbyl group containing about 1 to about 8, or about 1 to about 4 carbon atoms;

each $R^3$ is independently hydrogen or hydrocarbyl group containing 1 to 2 carbon atoms and, in one embodiment, each $R^3$ is hydrogen; and g is an integer in the range of about 1 to about 6 or about 1 to about 3.

Examples of a suitable nitrogen containing monomer include N,N-dimethylacrylamide, N-vinyl carbonamides (such as, N-vinyl-formamide, N-vinylacetoamide, N-vinyl-n-propionamides, N-vinyl hydroxyacetoamide), vinyl pyridine, N-vinyl imidazole, N-vinyl pyrrolidinone, N-vinyl caprolactam, dimethylaminoethyl acrylate, dimethylaminoethyl methacrylate, dimethyl-aminobutylacrylamide, dimethylaminopropyl methacrylate, dimethylamino-propylacrylamide, dimethylaminopropylmethacrylamide, dimethylaminoethyl-acrylamide or mixtures thereof.

For a functionalised polymer derived from monomers comprising: (i) a vinyl aromatic monomer; and (ii) a carboxylic monomer (such as, an unsaturated carboxylic acid or derivatives thereof), the nitrogen containing compound includes a non-monomeric amine such as a monoamine, a polyamine or mixtures thereof. The amine includes primary functionality, secondary functionality or mixtures thereof. The non-monomeric amine includes cyclic, linear or branched and examples include an alkylamine, a hydroxy-substituted hydrocarbyl amine, a heterocyclic monoamine, an alkylenepolyamine, an aromatic amine or polyamine, a heterocyclic polyamine or mixtures thereof. In one embodiment the amine contains not more than one primary or secondary amino group, for example N,N-dimethylaminopropylamine. In one embodiment the nitrogen containing monomer comprises a non-monomeric amine. (By "non-monomeric" is meant that the amine is not normally capable of polymerizing to form a polymer by virtue of the presence of, e.g., olefinic unsaturation.)

In one embodiment the amine includes a hydroxy-substituted hydrocarbyl amine such as a hydroxyalkyl amine. Examples of a suitable hydroxy-substituted hydrocarbyl amine include aminoethyl ethanolamine, aminopropyl ethanolamine, aminobutyl ethanolamine or mixtures thereof.

Suitable cyclic amines include 4-aminodiphenylamine, 4-(3-aminopropyl) morpholine, 4-(2-aminoethyl) morpholine or mixtures thereof. In one embodiment the cyclic amine is 4-(3-aminopropyl) morpholine or mixtures thereof. Other amines that may be suitable are described below in connection with phosphorus amine salts.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil or lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include polyol esters (such as Prolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils is prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content>0.03 wt %, and/or <90 wt % saturates, viscosity index 80-120); Group II (sulphur content ≦0.03 wt %, and ≧90 wt % saturates, viscosity index 80-120); Group III (sulphur content ≦0.03 wt %, and ≧90 wt % saturates, viscosity index≧120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group II, Group III or Group IV oil or mixtures thereof.

The amount of the oil of lubricating viscosity present is typically the balance remaining after subtracting from 100 wt % the sum of the amount of antiwear agent, the polymer and other performance additives.

The lubricating composition in one embodiment is in the form of a concentrate and/or a fully formulated lubricant. If the polymer and the antiwear agent are in the form of a concentrate (which may be combined with additional oil to form, in whole or in part, a finished lubricant), the ratio of the polymer and the antiwear agent to the oil of lubricating viscosity and/or to diluent oil include the ranges of about 1:99 to about 99:1 by weight, or about 80:20 to about 10:90 by weight.

Other Performance Additives

The lubricant composition optionally comprises other performance additives. The other performance additives comprise at least one of metal deactivators, conventional detergents (detergents prepared by conventional processes known in the art), dispersants, viscosity modifiers, friction modifiers, corrosion inhibitors, dispersant viscosity modifiers, extreme pressure agents, antiscuffing agents, antioxidants, foam inhibitors, demulsifiers, pour point depressants, seal swelling agents and mixtures thereof. Typically, fully-formulated lubricating oil will contain one or more of these performance additives.

The amount of other performance additives present in the lubricating composition of the invention includes ranges of about 0 wt % to about 50 wt %, or about 0.1 wt % to about 30 wt %, or about 0.2 wt % to about 15 wt % of the lubricating composition.

In one embodiment the lubricating composition further comprises at least one of dispersants or antioxidants.

The amount of dispersant includes ranges of about 0 wt % to about 10 wt %, or about 0.1 wt % to about 5 wt % of the lubricating composition.

The amount of detergent includes ranges of about 0 wt % to about 15 wt %, or about 0.1 wt % to about 8 wt % of the lubricating composition.

Dispersants

Dispersants are known as ashless-type dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range about 350 to about 5000, or about 500 to about 3000.

In one embodiment the invention further comprises at least one dispersant derived from polyisobutylene succinic acid or anhydride, an amine and zinc oxide to form a polyisobutylene succinimide complex with zinc. The polyisobutylene succinimide complex with zinc may be used alone or in combination.

Another class of ashless dispersant is Mannich bases. Mannich dispersants are the reaction products of alkyl phenols with aldehydes (especially formaldehyde) and amines (especially polyalkylene polyamines). The alkyl group typically contains at least about 30 carbon atoms.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

Detergents

The lubricant composition optionally further comprises known neutral or overbased detergents i.e. ones prepared by conventional processes known in the art. Suitable detergent substrates include, phenates, sulphur containing phenates, sulphonates, salixarates, salicylates, carboxylic acid, phosphorus acid, alkyl phenol, sulphur coupled alkyl phenol compounds, or saligenins.

Antioxidant

Antioxidant compounds are known and include sulphurised olefins, diphenylamines, hindered phenols, molybdenum dithiocarbamates, and mixtures thereof. Antioxidant compounds may be used alone or in combination.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or dodecyl 2,6-di-tert-butylphenol. In one embodiment the hindered phenol antioxidant is an ester and include, e.g., Irganox™ L-135 from Ciba. Suitable examples of molybdenum dithiocarbamates include commercial materials sold under the trade names such as Vanlube 822™ and Molyvan™ A from R. T. Vanderbilt Co., Ltd., and Adeka Sakura-Lube™ S-100, S-165 and S-600 from Asahi Denka Kogyo K. K and mixtures thereof.

Viscosity Modifiers

Viscosity modifiers other than the polymer of the present invention, include styrene-butadiene rubbers, ethylene-propylene copolymers, hydrogenated styrene-isoprene polymers, hydrogenated diene polymers, polyalkyl styrenes, polyolefins, polyalkyl (meth)acrylates and esters of maleic anhydride-styrene copolymers, or mixtures thereof. In one embodiment the polymeric thickener is a poly(meth)acrylate.

Antiscuffing Agent

The lubricant composition in one embodiment also contains an antiscuffing agent. Antiscuffing agent compounds are believed to decrease adhesive wear are often sulphur containing compounds. Typically the sulphur containing compounds include sulphurised olefins, organic sulphides and polysulphides, such as dibenzyldisulphide, bis-(chlorobenzyl)disulphide, dibutyl tetrasulphide, di-tertiary butyl polysulphide, sulphurised methyl ester of oleic acid, sulphurised alkylphenol, sulphurised dipentene, sulphurised terpene, sulphurised Diels-Alder adducts, alkyl sulphenyl N'N-dialkyl dithiocarbamates, the reaction product of polyamines with polybasic acid esters, chlorobutyl esters of 2,3-dibromopropoxyisobutyric acid, acetoxymethyl esters of dialkyl dithiocarbamic acid and acyloxyalkyl ethers of xanthogenic acids and mixtures thereof.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; sulphurised olefins (such as sulphurised isobutylene), organic sulphides and polysulphides such as dibenzyldisulphide, bis-(chlorobenzyl)disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Other performance additives such as corrosion inhibitors including octylamine octanoate, condensation products of dodecenyl succinic acid or anhydride and a fatty acid such as oleic acid with a polyamine; metal deactivators including derivatives of benzotriazoles, dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, poly(meth)acrylates, polyacrylates or polyacrylamides; and friction modifiers including fatty acid derivatives such as amines, esters, epoxides, fatty imidazolines, condensation products of carboxylic acids and polyalkylene-polyamines and amine salts of alkylphosphoric acids may also be used in the lubricant composition.

Industrial Application

The mechanical device includes gear boxes, automatic or manual transmissions, differentials, hydraulic systems or internal combustion engines.

The method and lubricating composition of the invention is suitable for gear oils, axle oils, drive shaft oils, traction oils, manual transmission oils, automatic transmission oils, working fluids, hydraulic oils, or internal combustion engine oils.

Lubricating compositions suitable for gear boxes, automatic or manual transmissions typically do not contain metal dialkyldithiophosphates.

Lubricating compositions suitable for hydraulic systems include ashless or metal containing (typically metal dialkyldithiophosphates e.g. zinc dialkyldithiophosphates).

Lubricating compositions suitable for hydraulic systems and transmissions (manual and/or automatic) in other embodiments contain about 0.1 wt % to about 15 wt %, or about 1 wt % to about 10 wt % of the polymer in the lubricating composition.

Lubricating compositions suitable for gears or gearboxes in different embodiments contain about 1 wt % to about 95 wt %, or about 10 wt % to about 85 wt %, or about 20 wt % to about 75 wt % of the polymer in the lubricating composition.

The method and lubricating compositions are capable of providing antiwear performance and at least one (or at least two, or all) of acceptable/improved, acceptable/improved shear stability, least of acceptable/improved viscosity index control and least of acceptable/improved low temperature viscosity.

When the polymer further comprises a nitrogen containing compound, the polymer has acceptable/improved dispersancy properties.

The internal combustion engine includes a 2-stroke or 4-stroke engine. Suitable internal combustion engines include a marine diesel engine, aviation piston engines, low-load diesel engines, automobile and truck engines.

The following examples provide an illustration of the invention. These examples are non exhaustive and are not intended to limit the scope of the invention.

EXAMPLES

Preparative Example 1

(Prep 1) A polymer is prepared by charging a mixing vessel with 412.5 g of 2-decyl tetradecyl methacrylate, 105 g of a Hydroseal™ mineral oil, 6.9 g of Trigonox®-21 and 6.9 g of n-dodecyl mercaptan and stirred. Approximately one-third of the mixture is then charged into a reaction vessel equipped with a mechanical overhead stirrer, water-cooled condenser, thermocouple, addition funnel and a nitrogen inlet. The vessel further contains 7.56 g of dimethylaminopropyl methacrylamide. The contents of the reaction vessel are stirred for 20 minutes under a nitrogen atmosphere (flow rate 28.3 L/hr). The nitrogen flow is then reduced to 14.2 L/hr and the mixture is set to be heated to 110° C. After 15 minutes, the reaction exotherm increases the temperature to 125° C., and the remaining contents of the mixing vessel are added to the reaction vessel over a period of 90 minutes through the addition funnel. one hour later, another 0.72 g of Trigonox®-21 and 2.55 g of Hydroseal™ mineral oil are added, before stirring for one hour. The product is cooled and analysed. The polymer formed contains 98.2 wt % of 2-decyl tetradecyl methacrylate units, and 1.8 wt % of dimethylaminopropyl methacrylamide units. The number average molecular weight is 8567, and weight average molecular weight is 13,479.

Preparative Example 2

(Prep 2) employs a similar experimental procedure to Preparative Example 1, except the oil is a Group III base oil, and the polymer formed has a number average molecular weight of 8500, and weight average molecular weight of 13,500.

Preparative Example 3

(Prep 3) employs a similar experimental procedure to Preparative Example 1, except the monomers are changed to prepare a polymer with a composition of 5 wt % methyl methacrylate, 93.2 wt % 2-decyl tetradecyl methacrylate and 1.8 wt % dimethylaminopropyl methacrylamide. The product formed has a number average molecular weight of 9100, and weight average molecular weight of 14,500.

Preparative Example 4

(Prep 4) is prepared by adding 490 g of maleic anhydride and 7.5 kg of toluene into a vessel (equipped with two addition funnels) and heating to 65° C. to substantially dissolve the maleic anhydride. The vessel is the heated to 106° C. Then 36.9 g of benzoyl peroxide (dissolved in 500 g of toluene) and 500 g of styrene are added over a period of 90 minutes to the vessel from the two addition funnels. The contents of the vessel are then stirred for one hour at 106° C. The product formed is a maleic anhydride styrene copolymer resin with a RSV of 0.07.

About 23 kg of the maleic anhydride styrene copolymer resin with a RSV of 0.07 is added to a vessel equipped with a reflux condenser and a nitrogen inlet, thermo-well and a stirring rod. To the vessel are added 768.2 g of 2-decyltetradecanol (Isofol®24) and 1438.2 g of Neodol®25 (a mixture of linear $C_{12-15}$ alcohols commercially available from Shell). The vessel is then heated with refluxing to 135° C. for 20 hours. 47.5 g of methanesulphonic acid is added and refluxing is continued for 20 hours, before adding an equivalent amount of sodium hydroxide to neutralize the methanesulphonic acid. The vessel is then heated to 150° C. and vacuum stripped and the resultant product is then filtered. The weight average molecular weight is 21,000.

Preparative Example 5

(Prep 5) is prepared in a similar experimental procedure as Preparative Example 4, except the alcohol used to prepare the ester groups is 100 mole % (6683.34 g) Isofol®24. The weight average molecular weight is 18500.

Lubricating Compositions 1-7

(Examples 1-7) are suitable for gears; and are prepared by blending the additives in amounts shown in Table 1 into a polyalphaolefin (PAO-4) oil of lubricating viscosity. The oil of lubricating viscosity contains up to 7 wt % of Lucant™ HC-200 olefin copolymer. The polymer is a polymethacrylate with 90 wt % or more with 2-decyltetradecanol (Isofol®24 alcohols) forming the ester group similar to the polymer of Preparative Example 1; and the antiwear agent is ashless. The lubricating composition further contains at least one other performance additive including dispersants and antioxidants. The lubricating compositions are:

TABLE 1

| | | Additives* | | Oil of Lubricating |
|---|---|---|---|---|
| Example | Polymer* (wt %) | Wt % of Antiwear Agent | Other Performance Additives | Viscosity Balance to 100 wt % |
| 1 | 52.0 | 1.7 | 5.8 | 40.5 |
| 2 | 48.0 | 3.0 | 5.9 | 43.1 |
| 3 | 46.4 | 3.0 | 5.9 | 44.7 |
| 4 | 34.4 | 3.0 | 11.7 | 50.9 |
| 5 | 32.0 | 3.0 | 11.7 | 53.3 |
| 6 | 30.4 | 1.7 | 12.3 | 55.6 |
| 7 | 25.6 | 3.0 | 5.8 | 65.6 |

Footnote:
*the amounts of polymer and additives in Table 1 are given on an actives basis, i.e. the wt % of the additive in the absence of oil.

Lubricating Compositions 8-10

(Examples 8-10) are suitable for gears; and are prepared by blending the additives in amounts shown in Table 2. The polymer is a maleic anhydride-styrene copolymer esterified with Isofol®24 alcohols. The copolymer has a RSV of about 0.05 or 0.07 (Preparative Example 4). The lubricating compositions further contain at least one antiwear agent and other performance additives including dispersants and antioxidants.

Comparative Example 1

(Compar1) is a maleic anhydride-styrene copolymer esterified with a mixture of 2-ethylhexanol and Neodol®25 alcohols (mixture of $C_{12-15}$ linear alcohols, commercially available from Shell).

TABLE 2

| | Polymer Esterified with Alcohols | | | | |
|---|---|---|---|---|---|
| Example | Amount of Isofol ® 24 Alcohol (mol %) | Amount of other Linear Alcohol (mol %) | Treat Rate of the Polymer (wt %) | Σ performance additives, including antiwear (wt %) | Oil of Lubricating Viscosity Balance to 100 wt % |
| 8 | 100 | 0 | 36.4 | 7.5 | 47.0 |
| 9 | 50 | 50 | 35.6 | 7.5 | 48/0 |
| 10 | 25 | 75 | 33.6 | 7.5 | 50.5 |
| Compar 1 | 0 | 0 | 34.8 | 7.5 | 49.0 |

Footnote:
* the amounts of polymer and additives in Table 2 are given on an actives basis, i.e. the wt % of the additive in the absence of oil.

Lubricating Compositions 11-13

(Examples 11-13) are suitable for automatic transmissions; and are prepared by blending the additives in amounts shown in Table 3. The polymer is a maleic anhydride-styrene copolymer esterified with Isofol®24 alcohols. The copolymer has a RSV of about 0.13. The lubricating compositions further contain at least one antiwear agent and other performance additives including dispersants and antioxidants.

TABLE 3

| | Polymer Esterified with Alcohols | | | | |
|---|---|---|---|---|---|
| Example | Amount of Isofol ® 24 Alcohol (mol %) | Amount of other Linear Alcohol (mol %) | Treat Rate of the Polymer (wt %) | Σ performance additives, including antiwear (wt %) | Oil of Lubricating Viscosity Balance to 100 wt % |
| 11 | 100 | 0 | 10 | 10 | 80 |
| 12 | 50 | 50 | 10 | 10 | 80 |
| 13 | 25 | 75 | 10 | 10 | 80 |

The lubricating compositions are then tested by measuring the Kinematic Viscosity using ASTM D2270 (KV100); and Brookfield low temperature performance using ASTM D2986 at −40° C. (BV40).

The lubricating compositions are also subjected to shear as determined by KRL tapered bearing shear stability test. The instrument is run for 20 hours with 5000 N load, at 140° C. and at 1450 rpm. The viscosity data (VI) obtained from the test is described in ASTM method D445. The results obtained for all three tests are presented in Table 4.

TABLE 4

| Example | BV −40 (1000's) | KV100 | VI |
|---|---|---|---|
| 1 | 21.5 | 16.2 | 209 |
| 2 | 30 | 20.1 | 201 |
| 3 | 53 | 19.2 | 201 |
| 4 | 37 | 20.6 | 197 |
| 5 | 124 | 19.4 | 197 |
| 6 | 37.5 | 19.6 | 191 |
| 7 | 22 | 16.1 | 202 |
| 8 | 55 | 17.1 | 180 |
| 9 | 67 | 17.3 | 173 |
| 10 | 95 | 17.1 | 164 |
| Compar1 | 220 | 17.58 | 152 |

The lubricating compositions of the invention are capable of providing acceptable/improved wear performance and at least one of acceptable/improved shear stability, viscosity index control and low temperature viscosity.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising:

(a) an oil of lubricating viscosity;

(b) a polymer of Formula (I), wherein the polymer has pendant groups as represented within $(\ )_w$ of the formula:

Formula (I)

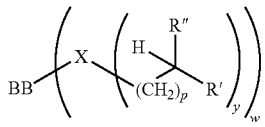

wherein

BB is a polymer backbone, wherein the polymer is a poly(meth)acrylate;

X is a functional group which either (i) contains at least one carbon and at least one oxygen or nitrogen atom, (ii) contains at least one acylating agent, or (iii) is an alkylene group with about 1 to about 5 carbon atoms, connecting the polymer backbone and a branched hydrocarbyl group contained within $(\ )_y$;

w is the number of pendant groups attached to the polymer backbone in the range of about 1 to about 2000;

y is 0, 1, 2 or 3, provided that in at least 1 mol % of the pendant groups, y is not zero; and with the proviso that when y is 0, X is bonded to a terminal group in a manner sufficient to satisfy the valence of X, wherein the terminal group is selected from hydrogen, alkyl, aryl, a metal or ammonium cation, and mixtures thereof;

p is an integer in the range of about 1 to about 15;

R' and R" are independently linear or branched hydrocarbyl groups, and the combined total number of carbon atoms present on R' and R" is at least about 12, wherein a steric hindrance factor F that is defined by the equation:

$$F=4U+Y$$

wherein F is the steric hindrance factor; U and Y represent the total atom numbers at the 6th position and the 7th position, respectively, in the side chain(s), counted from the backbone, and wherein the steric hindrance factor is about 20 to about 30; and (c) 0.05 wt % to about 10 wt % of an antiwear agent, wherein the antiwear agent is ashless.

2. The lubricating composition of claim 1, wherein the antiwear agent comprises an amine salt of a (thio)phosphorus compound.

3. The lubricating composition of claim 1 further comprising at least one of dispersants, antioxidants or mixtures thereof.

4. The lubricating composition of claim 1, wherein the polymer further comprises a nitrogen containing group.

5. The lubricating composition of claim 4, wherein the nitrogen containing group is derived from a nitrogen containing compound capable of reacting with a functionalised polymer backbone.

6. The lubricating composition of claim 4, wherein the nitrogen containing compound is derived from a nitrogen containing monomer.

7. The lubricating composition of claim 1, wherein the polymer is a poly(meth)acrylate with greater than 90% to about 100% of the groups within $(\ )_y$ are branched hydrocarbyl groups.

8. A method of controlling the viscosity index of a lubricant and antiwear performance, comprising supplying to the lubricant the lubricating composition of claim 1.

9. The method of claim 8, wherein the lubricant is suitable for at least one of hydraulic oils, gear oils, axle oils, drive shaft oils, traction oils, manual transmission oils or automatic transmission oils.

10. The lubricating composition of claim 1, wherein the polymer is present at about 0.1 wt % to about 15 wt % in at least one of hydraulic oils, manual transmission oils or automatic transmission oils.

11. The lubricating composition of claim 1, wherein the lubricant is suitable for gear oils.

12. The lubricating composition of claim 1, wherein the polymer is present at about 10 wt % to about 85 wt % of the lubricating composition in gear oils.

13. The lubricating composition of claim 1, wherein the steric hindrance factor is about 25 to about 30.

14. The lubricating composition of claim 1, wherein the antiwear agent comprises at least one of:

(i) a non-ionic (thio)phosphorus compound;

(ii) an amine salt,of a (thio)phosphorus compound;

(iii) ammonium salt of a (thio)phosphorus compound; or (iv) mixtures of (i), (ii), or (iii).

* * * * *